US006918951B2

(12) United States Patent
Rosenberg

(10) Patent No.: US 6,918,951 B2
(45) Date of Patent: Jul. 19, 2005

(54) DISC-TYPE AIR FILTERS

(75) Inventor: Gideon Rosenberg, Kiryat Tivon (IL)

(73) Assignee: Milow Ltd., Charleston, SC (US)

( * ) Notice: Subject to any disclaimer, the term of this patent is extended or adjusted under 35 U.S.C. 154(b) by 140 days.

(21) Appl. No.: 10/468,018

(22) PCT Filed: Feb. 26, 2002

(86) PCT No.: PCT/IL02/00151

§ 371 (c)(1),
(2), (4) Date: Aug. 25, 2003

(87) PCT Pub. No.: WO02/068125

PCT Pub. Date: Sep. 6, 2002

(65) Prior Publication Data

US 2004/0065203 A1 Apr. 8, 2004

Related U.S. Application Data

(60) Provisional application No. 60/271,652, filed on Feb. 28, 2001.

(51) Int. Cl.[7] ..... B03C 3/36; B03C 3/47

(52) U.S. Cl. ..... 96/60; 96/86; 96/87; 96/88

(58) Field of Search ..... 96/60, 67, 69, 96/72, 84, 86–88, 100; 55/332, 333; 210/108, 392, 492, 498; 95/59, 78

(56) References Cited

U.S. PATENT DOCUMENTS 2,868,319 A * 1/1959 Rivers ..... 96/67
2,974,747 A * 3/1961 Coolidge, Jr. et al. ..... 96/69
2,978,066 A * 4/1961 Nodolf ..... 96/87
3,152,988 A * 10/1964 Gutkowski et al. ..... 210/486
3,516,542 A * 6/1970 Jaume ..... 210/168
3,805,492 A * 4/1974 King ..... 95/66
4,661,250 A * 4/1987 Rosenberg ..... 210/352
4,740,302 A * 4/1988 Rosenberg ..... 210/392
4,793,928 A * 12/1988 Tsukamoto et al. ..... 210/344
5,171,433 A * 12/1992 Rosenberg ..... 210/108
5,582,632 A * 12/1996 Nohr et al. ..... 95/78
5,797,978 A * 8/1998 Rosenberg et al. ..... 95/74
6,391,097 B1 * 5/2002 Rosenberg ..... 96/87

FOREIGN PATENT DOCUMENTS

GB 480810 * 3/1938 ..... 210/492

* cited by examiner

*Primary Examiner*—Richard L. Chiesa
(74) *Attorney, Agent, or Firm*—G.E. Ehrlich Ltd.

(57) ABSTRACT

An air filter includes a stack of filter discs formed with contacting faces having surface formations defining filtering passageways between adjacent discs for removing solid particles from the air passing through the stack. The filter discs in the stack further include electrodes spaced from each other axially of the stack and connectable to a voltage source for producing an electrical field attracting solid particles towards the discs to thereby enhance removal of the solid particles from the air passing through the stack. The filter discs in the stack include a first plurality of insulating discs composed of insulating material, and a second plurality of electrode discs composed of electrically-conductive material, with the electrode discs separated from each other by at least one insulating disc.

11 Claims, 4 Drawing Sheets

DISC-TYPE AIR FILTERS

RELATED PATENT APPLICATIONS

This application is a National Phase Patent Application of PCT Patent Application No. PCT/IL02/00151 filed 26 Feb. 2002, which claims priority from U.S. Provisional Patent Application No. 60/271,652, filed 28 Feb. 2001.

FIELD AND BACKGROUND OF THE INVENTION

The present invention relates to air filters, and particularly to disc-type air filters for filtering air with respect to dust or other particles within the air or other gases.

The term "air filters" as used herein is intended to include filters not only for air, but also for other gases.

U.S. Pat. No. 5,797,978, and International Patent Application PCT/ILOO/00351, published Dec. 28, 2000 as International Publication No. WO 00/78428, disclose an air filter comprising a housing having an air inlet, an air outlet, and a stack of filter discs within the housing for removing solid particles from the air passing from the inlet to the outlet. The filter discs in the stack are formed with contacting faces having surface formations defining filtering passageways between adjacent discs for removing solid particles from the air passing through the stack of filter discs. The filter discs in the stack include electrodes spaced from each other axially of the stack and connectable to a voltage source for producing an electrical field attracting solid particles towards the discs to thereby enhance removal of the solid particles from the air passing through the stack of filter discs.

The above-identified US Patent and International Patent Application, the contents of which are hereby incorporated by reference, describe many of the advantages of such an air filter construction.

In the embodiments of air filter constructions described in the above-identified US Patent and International Patent Application, each of the filter discs is of a composite construction, including an electrode layer embedded between two insulating layers. The insulating layers serve as the outer faces of the filter discs and include the surface formations defining the filtering passageways between adjacent discs, while the electrode layers in each filter disc, when connected to a voltage source, produce the electrical field attracting solid particles towards the disc.

The composite disc construction utilized in the filters described in the above-identified US Patent and International Patent Application requires insulating layers on both sides of each disc which definitely increase the thickness of the discs. This limits the number of discs that can be packed in certain dimensions of the filter and accordingly the total filtering passageways that can be provided for the same filter volume. It also limits the amount of dirt particles that can be retained within the filter stack before cleaning or replacing the filter is required. In addition, implementation of the electrode layer in the injection process of the disc has a considerable cost impact which makes the composite disc more expensive to produce and thereby increases the manufacturing cost of such air filters.

OBJECTS AND BRIEF SUMMARY OF THE PRESENT INVENTION

An object of the present invention is to provide an air filter of the foregoing type providing advantages in one or more of the above respects.

According to a broad aspect of the present invention, there is provided an air filter, comprising: a housing having an air inlet, an air outlet, and a stack of filter discs within the housing for removing solid particles from the air passing from the inlet to the outlet; the filter discs in this stack being formed with contacting faces having surface formations defining filtering passageways between adjacent discs for removing solid particles from the air passing through the stack of filter discs; the filter discs in the stack including electrodes spaced from each other axially of the stack and connectable to a voltage source for producing an electrical field attracting solid particles towards the discs to thereby enhance removal of the solid particles from the air passing through the stack of filter discs; characterized in that the filtered discs in the stack include a first plurality of insulating discs of insulating material alone, and a second plurality of electrode discs of electrically-conductive material alone, with the electrode discs separated from each other by at least one insulating disc.

As will be more particularly described below, such a construction provides a number of important advantages over the constructions illustrated in the above-cited US Patent and International Patent Application. Thus the novel construction permits the electrode discs to be made substantially thinner, thereby allowing more filtering passageways for the same filter volume. This enhances the filter's flow characteristics (reduces its restriction thereby allowing higher flow rate) as well as increases the dirt-holding capacity of the filter, and thereby increases the time periods required between filter cleaning or replacement. The novel construction also simplifies the manufacture of the electrode discs and permits them to be produced at considerably lower cost.

The electrode discs may be composed of electrically-conductive plastic or of metal. When the electrode discs are composed of electrically-conductive plastic, they may be produced in volume and at low cost by conventional plastic injecting techniques; and when they are composed of metal, they may be produced in volume and at low cost by metal-stamping techniques.

According to further features in the described preferred embodiments, the surface formations in the contacting faces of the discs include sinuous ribs formed on at least one contacting face of one of the discs. Preferably, the sinuous ribs are formed on at least one contacting face of each of the insulating discs. Since the thickness of the sinuous ribs disc is greater than the thickness of the annular ribs disc, a better electrical insulation is maintained for this configuration.

An even more preferred construction is one wherein the sinuous ribs are formed on both contacting faces of each of the insulating discs. Two preferred embodiments are described below utilizing such a construction. In one described preferred embodiment, the electrode discs are formed on both contacting faces with a plurality of annular ribs contacting the sinuous ribs of the insulating discs to define the filtering passageways; whereas in a second described preferred embodiment, the electrode discs are formed on both contacting faces with a plurality of discrete spot protrusions contacting the sinuous ribs of the insulating discs to define the filtering passageways.

A still further embodiment is described below wherein the surface formations in the contacting faces of the two discs include a plurality of discrete spot protrusions formed on the sinuous ribs on each of the contacting faces of the insulating discs, whereas the electrode discs have flat planar contacting faces to define the filtering passageways between adjacent discs.

According to a further feature in the described preferred embodiments, the discs are tightened in the stack by a plurality of circumferentially-spaced axially-extending tie rods. Such tie rods keep the discs centered with respect to the filter axis and help to facilitate the air flow through the stack of discs. Two of these tie rods also serve as electrical connections to the electrode discs.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
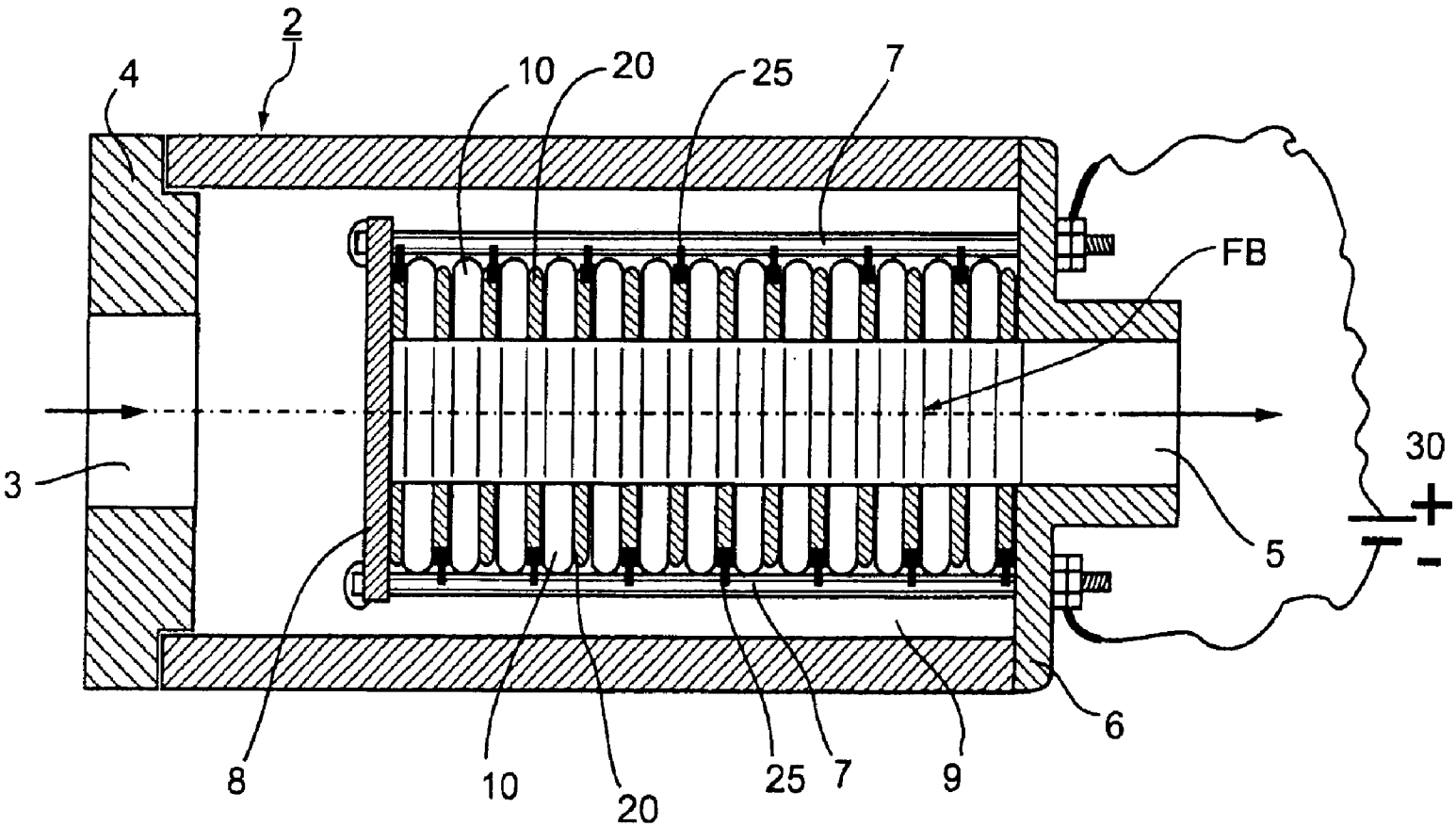
FIG. 1 is a longitudinal sectional view illustrating one form of air filter constructed in accordance with the present invention.

For purposes of example, the filters illustrated in the drawings are of the disc type air filter as described in the above-identified US Patent and International Patent Application, but modified in accordance with the present invention to provide a number of advantages as will be described more particularly below.

As illustrated in FIG. 1, the illustrated air filter includes a cylindrical housing 2 having an inlet 3 formed in an end wall 4 closing one end of the housing, and an outlet 5 formed in an end wall 6 closing the opposite end of the housing. The illustrated filter further includes a filter body, generally designated FB, in the form of a plurality of annular filter discs of one type arranged in a stack each alternating with one of a plurality of annular discs of another type. The discs are secured to the housing 2 by a plurality of axially-extending, circumferentially-spaced tie rods 7, with the central openings of the discs aligned with the housing outlet, and with the opposite end of the stack closed by a non-apertured end disc 8. The outer diameter of the discs is less than the inner diameter of the housing 2, such that an annular space 9 is defined between the stack of discs and the inner face of the housing. It will be seen that air entering the filter housing 2 via inlet 3 is forced to flow in the annular space 9 around the filter body FB, radially between the contacting faces of the filter discs 10, 20 of the filter body, and out through the housing outlet 5.

The two types of discs in the stack are generally designated 10 and 20, respectively. Discs 10 are insulating discs, being composed of insulating material; whereas discs 20 are electrode discs, being composed of electrically-conductive material. The two types of discs are disposed in the stack in an alternating relation such that the opposite side faces of each electrode disc 20 are in direct contact with the side faces of the two insulating discs on its opposite sides. The contacting faces of all the discs include surface formations defining small filtering passageways for filtering air passing between the contacting faces from the air inlet 3 to the air outlet 5.

Figure 2:
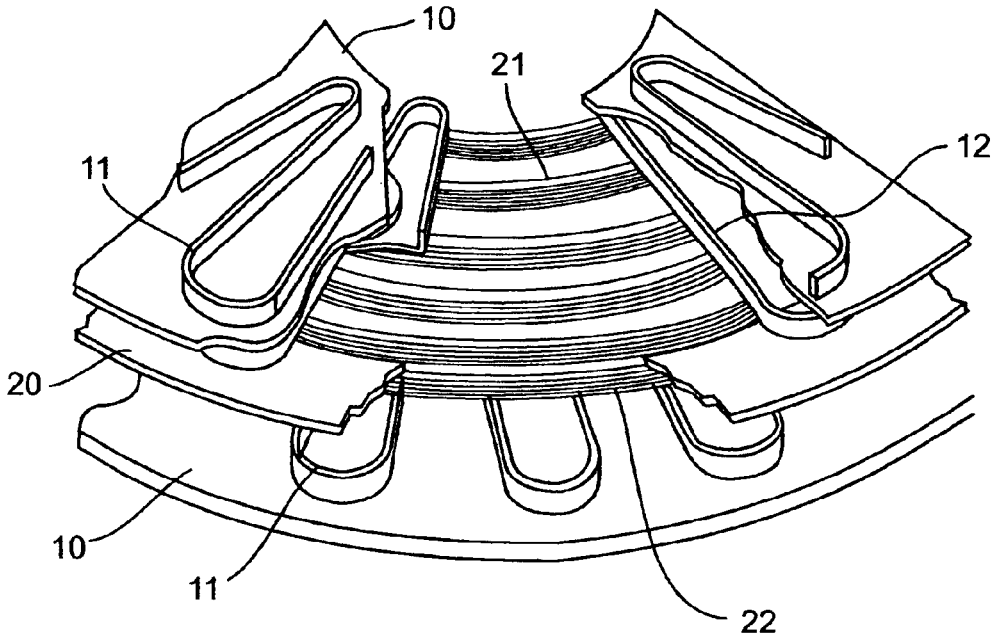
FIG. 2 is a fragmentary perspective view more particularly illustrating the two types of filter discs in the air filter of FIG. 1.
Figure 3A:
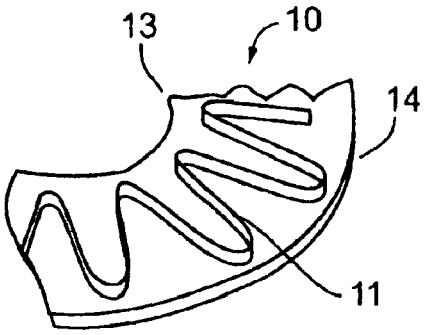
FIG. 3*a* is a fragmentary perspective view.
Figure 3B:
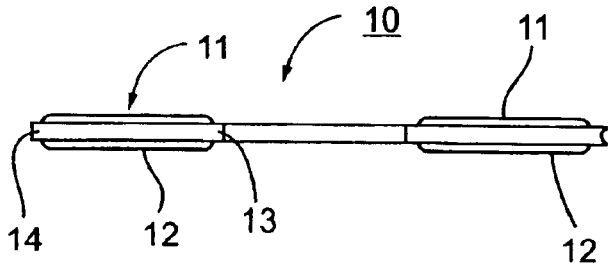
FIG. 3*b* is a side view, illustrating the construction of the insulating discs in the air filter of FIG. 1.
Figure 4A:
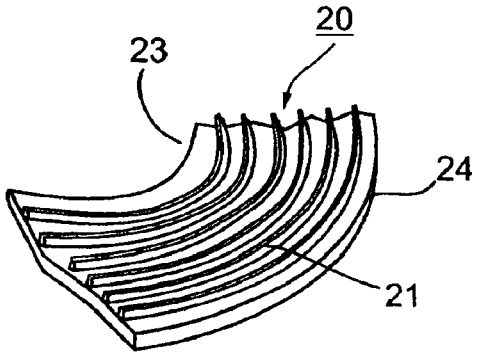
FIG. 4*a* is fragmentary perspective view.
Figure 4B:
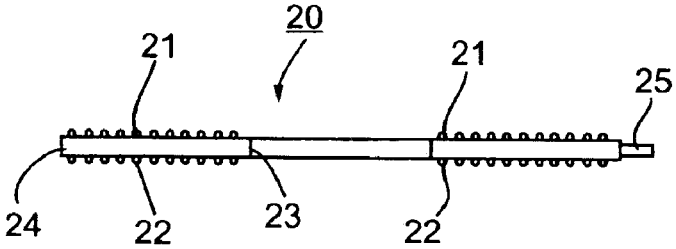
FIG. 4*b* is a side view, illustrating the construction of the electrode discs in the air filter of FIG. 1.

As shown in FIGS. 2, 3*a* and 3*b*, each of the insulating discs 10 is made of a suitable plastic material and includes substantially planar faces on its opposite sides each formed with a sinuous rib 11, 12 extending substantially from the inner edge 13 to the outer edge 14 of the disc. As shown in FIGS. 2, 4*a* and 4*b*, each of the electrode discs 20 is made of an electrically-conductive material and is formed on its opposite faces with a plurality of concentric annular ribs 21, 22, of increasing diameter from the inner edge 23 to the outer edge 24 of the disc. In addition, each electrode disc 20 is provided with an electrical terminal 25 for making an electrical connection thereto. The electrode discs 20 are assembled in the stack with the insulating discs 10 such that the terminals 25 project alternatingly from opposite sides of the stack to facilitate the electrical connections to the electrode discs by means of metallic tie rods 7, or by other types of electrical conductors (not shown) carried by such tie rods.

As seen particularly in FIG. 2, each pair of contacting faces of discs 10, 20 in the stack include a sinuous rib 11, 12 of an insulating disc 10 and annular ribs 21, 22 of an electrode disc 20. The main portions of the sinuous ribs 11, 12 extend substantially radially of their respective insulating discs 10, whereas the annular ribs 21, 22 extend substantially circularly around their respective electrode discs 20. Accordingly, the annular ribs cross the sinuous ribs at substantially right angles to define small filtering passageways between the ribs. It will be seen that each of such filtering passageways has a height equal to the protrusion of the annular ribs 21,22, a breadth equal to the distance between any two adjacent annular ribs 21,22, and a length (depth) equal to the thickness of the sinuous ribs 11,12.

As shown in FIG. 1, the illustrated air filter further includes a DC voltage source 30 electrically connected to the terminals 25 of the electrode discs 20. Terminal 25 of every other electrode disc 20 projects from one side of the stack and is connected to one pole of the battery via tie rod 7, or an electrical conductor carried by the tie rod; whereas the other terminals 25 projecting from the opposite sides of the stack are connected to the other pole of the battery.

It will thus be seen that, as described in the above-identified US Patent and International Patent Application, the air filter illustrated in FIGS. 1–4*b* removes the solid particles in the entering air by both a mechanical filtration action and an electrostatic precipitation action. Thus the air inletted via inlet 3 is directed by the end disc 8 to the outer annular space 9 between the filter body FB and the inner surface of the housing 2, then radially between the contacting faces of the insulating discs 10 and electrode discs 20 in the filter body FB, and finally out through the outlet 5. The narrow filtering passageways defined between the sinuous ribs 11, 12 of the insulating discs 10, and the annular ribs 21, 22 of the electrode discs 20, prevent solid particles in the air stream from passing through the filter body FB. In addition, the electrostatic field produced by the oppositely-charged electrode discs 20, spaced by the insulating discs 10, attract the dirt particles to the surfaces of the insulating discs 10, where they tend to accumulate on the inlet sides of the sinuous ribs 11, 12. Should there be a failure of the power supply, the filtering passageways defined by the sinuous ribs 11, 12 and the annular ribs 21, 22 will be effective to block most of the particles from reaching the outlet.

As also described in the above-identified US Patent and International Patent Application, the air filter may be cleaned whenever desired by reverse-flushing, namely by directing air through the outlets towards the inlet 3. At the same time, the electrical connections to the electrode terminals 25 may be reversed so that the electrostatic fields produced by those electrode discs will now repel the particles from the surfaces to which they had been attracted, thereby enhancing the reverse flushing of the filter body.

It will thus be seen that, whereas the filter discs in the above-identified US Patent and International Patent Application are of a composite construction, including an electrode layer sandwiched between two insulating layers, the filter discs in the air filter illustrated in FIGS. 1–4*b* include two types of filter discs both of a relatively simpler construction, namely an insulating disc 10 composed of insulating material, and an electrode disc 20 composed of electrically-conductive material. Each disc may therefore be designed and dimensioned for optimum performance of its respective function. Thus, the electrode discs 20 may be designed and dimensioned to perform their function of producing the electrostatic field within the filter body, whereas the insulating discs 10 may be designed to space the electrode discs from each other to enable the electrode discs to produce the electrostatic field and to prevent voltage breakdown.

Such an arrangement provides a number of important advantages. One important advantage is that it enables both the electrode discs 20 and the insulating discs 10 to be made thinner, so as to allow to pack more discs in the same filter dimensions thereby to increase the total number of filtering passageways for a given filter volume. This not only enhances the filter's flow characteristics, but also increases the dirt-holding capability of the filter for a given filter volume, thereby increasing the time periods before cleaning or replacing the filter is required.

Another important advantage is that the filter discs, being of a much simpler construction as compared to the composite construction illustrated in the above-identified US Patent and International Patent Application, can be produced in volume and at low cost by existing manufacturing techniques. For example, the insulating discs 10 can be produced by a simple plastic-molding process; whereby the electrode discs 20, if made of electrically-conductive plastic material, can also be produced by conventional plastic injection process, and if made of metal, such as aluminum, they can be produced by conventional metal-stamping processes.

As one example, the, insulating discs 10 may be of polyethylene, polypropylene, nylon or of a polyacetal resin, having a total thickness of 1.0–1.5 mm. A preferred construction for the insulating discs 10 is 0.5 mm for the base thickness, and 0.5 mm for each of the sinuous ribs 11, 12 on each side of the disc, or a total thickness of 1.5 mm. This is compared with a total thickness of 2.2 mm required for making the composite disc that was described in the reference patent.

The electrode discs 20, if made of electrically-conductive plastic, preferably have a thickness of 0.3–0.5 mm, with the annular ribs 21, 22 having a thickness (i.e., height) of about 5–15 microns; particularly good results are obtainable when the thickness of the conductive plastic electrode discs 20 is 0.50 mm, with a rib thickness (height) of about 10 microns on each face. On the other hand, if the electrode discs 20 are made of metal, such as aluminum, preferably they have a total thickness of 0.1–0.2 mm, with the annular ribs 21, 22 having a thickness (height) of about 5–15 microns.

For applications with corrosive gases, metal electrode discs may be plated with a layer of an anti-corrosive dielectric material; for example, an aluminum electrode disc may be plated with aluminum oxide, nitride, or with a plastic material. Such plating material may be electrically insulating—obviously appropriate to maintain the electric field function.

Figure 5A:
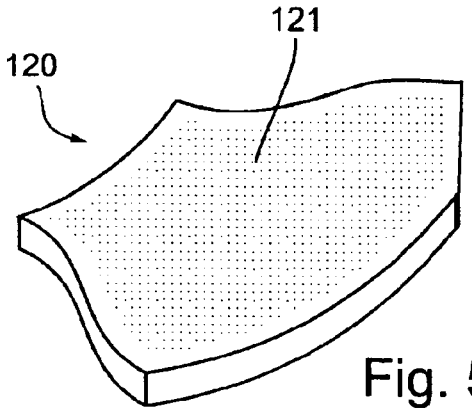
FIG. 5*a* is a fragmentary perspective view.
Figure 5B:
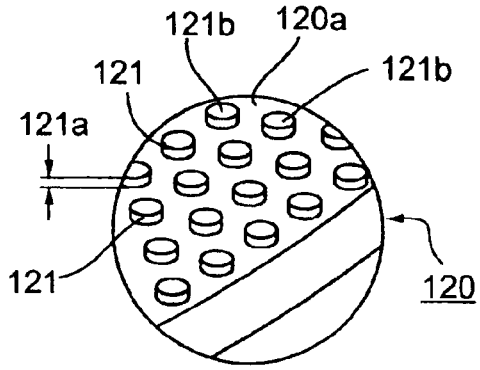
FIG. 5*b* is an enlarged fragmentary view, illustrating an alternative construction for the electrode discs in the air filter of FIG. 1.

FIGS. 5*a* and 5*b* illustrate a variation in the construction of the electrode discs, therein designated 120, corresponding to one of the variations described in the above-cited International Patent Application. Thus, as shown in FIGS. 5*a* and 5*b,* the electrode discs 120, instead of being formed with the annular ribs (21, 22, FIGS. 2, 4*a,* 4*b*), they are rather formed with a plurality of discrete spot-like protrusions 121 on one face, and corresponding protrusions (not shown) on the opposite face. These protrusions cooperate with the sinuous ribs 11, 12 in the insulating discs 10, (FIGS. 2, 3, 3*b*) to produce the filtering passageways as described in the above-cited International Patent Application.

As shown particularly in FIG. 5*b,* the discrete spot protrusions 121 project from a flat planar surface 120*a* of the electrode disc 120. They are of cylindrical shape, have a height 121*a* of the order of 5–15 microns, and have a flat outer face 121*b*. These protrusions are sufficiently small in size and in spacing from each other such that a plurality of such protrusions extend across the width of the respective sinuous rib (11, 12) of the insulating disc they contact.

Figure 6:
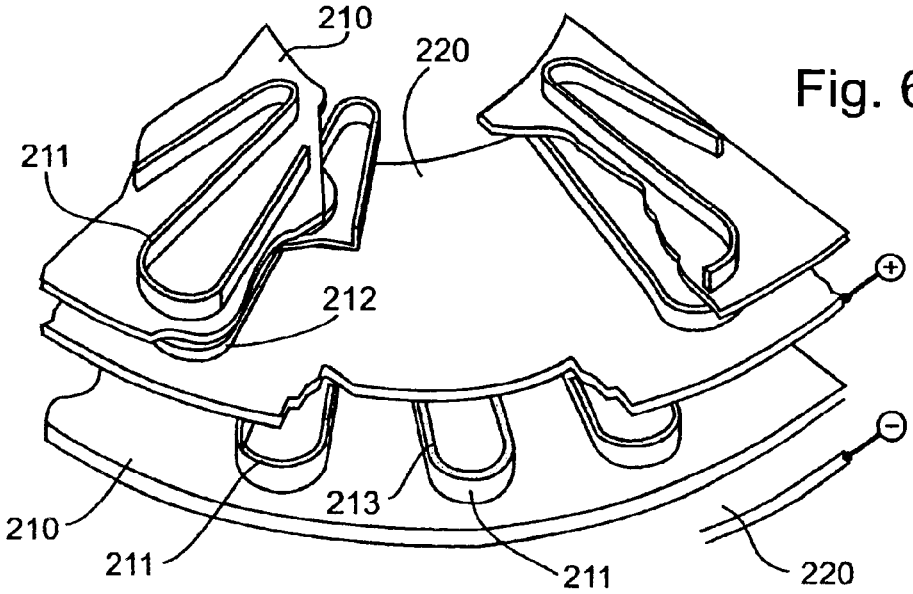
FIG. 6 is a fragmentary perspective view illustrating a modification in the construction of the insulating discs and the electrode discs in the air filter of FIG. 1.
Figure 7:
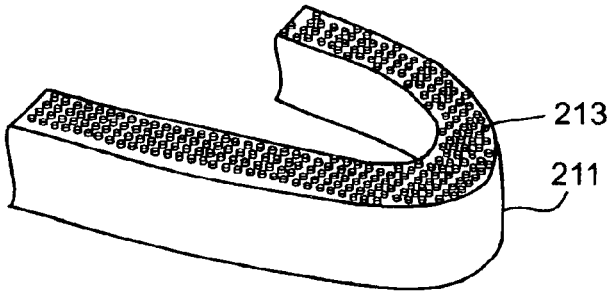
FIG. 7 is an enlarged perspective view more particularly illustrating the construction of one of the sinuous ribs in the insulating discs in the modification of the air filter of FIG. 6.

FIGS. 6 and 7 illustrates a further variation in the construction of the insulating discs 210, and of the electrode discs 220, corresponding to another variation described in the above-cited International Application. As shown in FIGS. 6 and 7, the spot-like protrusions 213 are intregally formed on the outer surfaces of the sinuous ribs 211, 212 of the insulating discs 210, rather than on the contacting faces of the electrode discs 220. Accordingly, the contacting faces of the electrode discs 220 would be flat, planar faces.

While the invention has been described with respect to several preferred embodiments, it will be appreciated that these are set forth merely for purposes of example, and that many other variations may be made. For example, discs 20 may be made from insulating material and discs 10 from conductive material. Also, each electrode disc may be separated by more than one insulating disc. In addition, the electrical terminals for connecting the electrode discs to the voltage source could be carried by the insulating discs, rather than by the electrode discs, such that the terminals make direct contact with the electrically-conductive faces of the respective electrode discs. Also, any of the other variations described in the above-cited US Patent or International Patent Application, the contents of which are incorporated herein by reference, could be included in the air filter constructed in accordance with the present invention. Many other variations, modifications and applications of this invention will be apparent.

What is claimed:

1. An air filter, comprising:

a housing having an air inlet, an air outlet, and a stack of filter discs within the housing for removing solid particles from the air passing from said inlet to said outlet;

said filter discs in the stack being formed with contacting faces having surface formations defining filtering passageways between adjacent discs for removing solid particles from the air passing through said stack of filter discs;

said filter discs in the stack including electrodes spaced from each other axially of the stack and connectable to a voltage source for producing an electrical field attracting solid particles towards the discs to thereby enhance removal of the solid particles from the air passing through said stack of filter discs;

characterized in that said filter discs in the stack include a first plurality of insulating discs of insulating material alone, and a second plurality of electrode discs of electrically-conductive material alone, with the electrode discs separated from each other by at least one insulating disc.

2. The air filter according to claim 1, wherein said electrode discs are composed of electrically-conductive plastic material.

3. The air filter according to claim 1, wherein said electrode discs are composed of metal.

4. The air filter according to claim 3, wherein said metal disc is plated with a dielectric material.

5. The air filter according to claim 1, wherein said surface formations include sinuous ribs formed on a contacting face of each disc in one of said pluralities.

6. The air filter according to claim 5, wherein said sinuous ribs are formed on a contacting face of each of said insulating discs.

7. The air filter according to claim 5, wherein said sinuous ribs are formed on both contacting faces of each of said insulating discs.

8. The air filter according to claim 7, wherein said surface formations include a plurality of annular ribs formed on both contacting faces of each of said electrode discs.

9. The air filter according to claim 7, wherein said surface formations include a plurality of discrete spot protrusions formed on both contacting faces of each of said electrode discs.

10. The air filter according to claim 7, wherein said surface formations include a plurality of discrete spot protrusions formed on said sinuous ribs on each of the contacting faces of the insulating discs, and said electrode discs have planar contacting faces.

11. The air filter according to claim 1, wherein said plurality of discs are assembled in said stack by a plurality of circumferentially-spaced, axially-extending tie rods which include said electrical connections to said electrode discs.

* * * * *